US010837086B2

(12) United States Patent
Das et al.

(10) Patent No.: US 10,837,086 B2
(45) Date of Patent: Nov. 17, 2020

(54) HIGH-STRENGTH CORROSION-RESISTANT 6XXX SERIES ALUMINUM ALLOYS AND METHODS OF MAKING THE SAME

(71) Applicant: Novelis Inc., Atlanta, GA (US)

(72) Inventors: Sazol Kumar Das, Acworth, GA (US); Rajeev G. Kamat, Marietta, GA (US); Milan Felberbaum, Woodstock, GA (US)

(73) Assignee: NOVELIS INC., Atlanta, GA (US)

( * ) Notice: Subject to any disclaimer, the term of this patent is extended or adjusted under 35 U.S.C. 154(b) by 151 days.

(21) Appl. No.: 15/989,447

(22) Filed: May 25, 2018

(65) Prior Publication Data

US 2018/0340244 A1 Nov. 29, 2018

Related U.S. Application Data

(60) Provisional application No. 62/511,703, filed on May 26, 2017.

(51) Int. Cl.

| | |
|---|---|
| ***C22C 21/08*** | (2006.01) |
| ***C22C 21/02*** | (2006.01) |
| ***C22F 1/05*** | (2006.01) |
| ***B22D 11/00*** | (2006.01) |
| ***B22D 11/049*** | (2006.01) |
| ***C22F 1/047*** | (2006.01) |

(52) U.S. Cl.

CPC ..... *C22C 21/08* (2013.01); *B22D 11/003* (2013.01); *B22D 11/049* (2013.01); *C22C 21/02* (2013.01); *C22F 1/047* (2013.01); *C22F 1/05* (2013.01)

(58) Field of Classification Search

CPC ..... C22C 21/08; C22F 1/047; B22D 11/049

See application file for complete search history.

(56) References Cited

U.S. PATENT DOCUMENTS

| | | | | |
|---|---|---|---|---|
| 4,174,232 | A | 11/1979 | Lenz et al. | |
| 5,858,134 | A * | 1/1999 | Bechet | C22C 21/08 148/550 |
| 5,961,752 | A | 10/1999 | Bergsma | |
| 10,533,243 | B2 | 1/2020 | Newman et al. | |
| 10,550,455 | B2 | 2/2020 | Hosch et al. | |

(Continued)

FOREIGN PATENT DOCUMENTS

| | | |
|---|---|---|
| FR | 2826979 | 1/2003 |
| FR | 2902442 | 12/2007 |

OTHER PUBLICATIONS

AZoM ("Aluminium/Aluminum 6020 Alloy (UNS A96020)", Apr. 25, 2013, https://www.azom.com/article.aspx?ArticleID=8610#:~:text=Aluminium%20%2F%20aluminum%206020%20alloy%20is,very%20good%20response%20to%20anodizing.) (Year: 2013).*

(Continued)

*Primary Examiner* — Christopher S Kessler
*Assistant Examiner* — Jiangtian Xu
(74) *Attorney, Agent, or Firm* — Kilpatrick Townsend & Stockton LLP

(57) ABSTRACT

The present disclosure generally provides 6xxx series aluminum alloys and methods of making the same, such as through casting and rolling. The disclosure also provides products made from such alloys. The disclosure also provides various end uses of such products, such as in automotive, transportation, electronics, aerospace, and industrial applications, among others.

20 Claims, 5 Drawing Sheets

(56) References Cited

U.S. PATENT DOCUMENTS

| | | | | |
|---|---|---|---|---|
| 2003/0087122 | A1* | 5/2003 | Benedictus ..... | B32B 15/016<br>428/654 |
| 2005/0028894 | A1 | 2/2005 | Hoffmann et al. | |
| 2005/0288894 | A1 | 12/2005 | Vorenkamp et al. | |
| 2008/0145266 | A1 | 6/2008 | Chen et al. | |

OTHER PUBLICATIONS

PCT/US2018/034572 , "International Search Report and Written Opinion", dated Sep. 11, 2018, 10 pages.

* cited by examiner

50°C/h → 450°C no soak

50°C/h → 500°C no soak

50°C/h → 540°C no soak

50°C/h → 560°C + 6h soak@560°C

Alloy A1_CC

Alloy A2_CC

Alloy A3_CC

Alloy A4_CC

Alloy A1_DC

HIGH-STRENGTH CORROSION-RESISTANT 6XXX SERIES ALUMINUM ALLOYS AND METHODS OF MAKING THE SAME

CROSS-REFERENCE TO RELATED APPLICATION

The present application claims the benefit of priority of U.S. Provisional Application No. 62/511,703, filed May 26, 2017, which is hereby incorporated by reference as though set forth herein in its entirety.

FIELD

The present disclosure generally provides 6xxx series aluminum alloys. The disclosure also provides products made from such alloys and methods of making such products, such as through casting and rolling. The disclosure also provides various end uses of such products, such as in automotive, transportation, electronics, industrial, aerospace, and other applications.

BACKGROUND

High-strength aluminum alloys are desirable for use in a number of different applications, especially those where strength and durability are especially desirable. For example, aluminum alloys under the 6xxx series designation are commonly used for automotive structural and closure panel applications in place of steel. Because aluminum alloys are generally about 2.8 times less dense than steel, the use of such materials reduces the weight of the vehicle and allows for substantial improvements in its fuel economy. Even so, the use of currently available aluminum alloys in automotive applications poses certain challenges.

One particular challenge relates to the tendency of 6xxx series aluminum alloys to be weaker than steel. In some instances, it is possible to alter the alloy composition to increase the strength of the finished aluminum alloy product, for example, by increasing the amount of silicon or copper in the alloy composition. However, increasing the silicon or copper concentration in the alloy often leads to precipitate formation at the grain boundary, which, in turn, decreases the corrosion resistance of the finished product. Original equipment manufacturers (OEMs) continue to face pressure from regulators and consumers to offer more fuel-efficient vehicles that are also safe and durable.

SUMMARY

Covered embodiments of the invention are defined by the claims, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification, any or all drawings, and each claim.

The present disclosure provides novel 6xxx series aluminum alloys that have both high strength and high corrosion resistance. Among other things, including higher amounts of minor alloying elements (for example, Mn, Cr, Zr, V, etc.) improves the corrosion resistance of products formed from the aluminum alloy without causing a substantial loss in strength. Without being bound to any particular theory, it is believed that including higher amounts of minor alloying elements leads to the formation of a large number of dispersoids during homogenization, which can serve as nucleation sites for silicon or copper. Because these precipitates form at the location of the dispersoids, they do not form in any substantial degree at grain boundaries. Therefore, the grain boundaries do not become sites for subsequent intergranular corrosion.

Disclosed is an aluminum alloy comprising 0.2 to 1.5 percent by weight Si; 0.4 to 1.6 percent by weight Mg; 0.2 to 1.5 percent by weight Cu; no more than 0.5 percent by weight Fe; one or more additional alloying elements selected from the group consisting of: 0.08 to 0.20 percent by weight Cr, 0.02 to 0.20 percent by weight Zr, 0.25 to 1.0 percent by weight Mn, and 0.01 to 0.20 percent by weight V; and the remainder aluminum. In some examples, the aluminum alloy comprises no more than 0.20 percent by weight Sr, no more than 0.20 percent by weight Hf, no more than 0.20 percent by weight Er, or no more than 0.20 percent by weight Sc. Throughout this application, all elements are described in percent by weight (wt. %), based on the total weight of the alloy. These alloys exhibit high strength and corrosion resistance, and can be used suitably in a variety of applications, including automotive, transportation, electronics, aerospace, and industrial applications, among others.

Also disclosed is an aluminum alloy product, comprising an aluminum alloy as described above. In some cases, the aluminum alloy product is an ingot, a strip, a shate, a slab, a billet, or other aluminum alloy product. In other examples, the aluminum alloy product is a rolled aluminum alloy product, which is formed by a process that includes rolling the aluminum alloy product, for example, until a desired thickness is achieved. The rolled aluminum alloy product can be an aluminum alloy sheet. Such sheets can have any suitable temper, e.g., ranging from the T1 to T9 temper, and any suitable gauge. In other examples, the disclosure provides aluminum plates, extrusions, castings, and forgings comprising a 6xxx series alloy as provided herein.

Also disclosed is a method of making an aluminum alloy product, the method comprising providing an aluminum alloy as described herein, wherein the aluminum alloy is provided in a molten state as a molten aluminum alloy, and continuously casting the molten aluminum alloy to form an aluminum alloy product. The method can further comprise rolling the aluminum alloy product, for example, following homogenization, to form a rolled aluminum alloy product, such as an aluminum alloy sheet.

In other examples, the method can include direct chill (DC) casting the molten aluminum alloy to form an aluminum alloy product, such as an ingot, and rolling the aluminum alloy product, for example, following homogenization, to form a rolled aluminum alloy product, such as an aluminum alloy sheet.

Also disclosed is an article of manufacture comprising an aluminum alloy product as described herein. The article of manufacture can include a rolled aluminum alloy product. Examples of such articles of manufacture include, but are not limited to, an automobile, a truck, a trailer, a train, a railroad car, an airplane, a body panel or part for any of the foregoing, a bridge, a pipeline, a pipe, a tubing, a boat, a ship, a storage container, a storage tank, an article of furniture, a window, a door, a railing, a functional or decorative architectural piece, a pipe railing, an electrical component, a conduit, a beverage container, a food container, or a foil. In some examples, the articles of manufacture are automotive or transportation body parts, including motor vehicle body parts (e.g., bumpers, side beams, roof beams, cross beams, pillar reinforcements, inner panels, outer panels, side panels, hood inners, hood outers, and trunk lid panels). The article of manufacture can also include electronic products, such as electronic device housings.

Additional aspects and embodiments are set forth in the detailed description, claims, non-limiting examples, and drawings, which are included herein.

DETAILED DESCRIPTION

Figure 1:
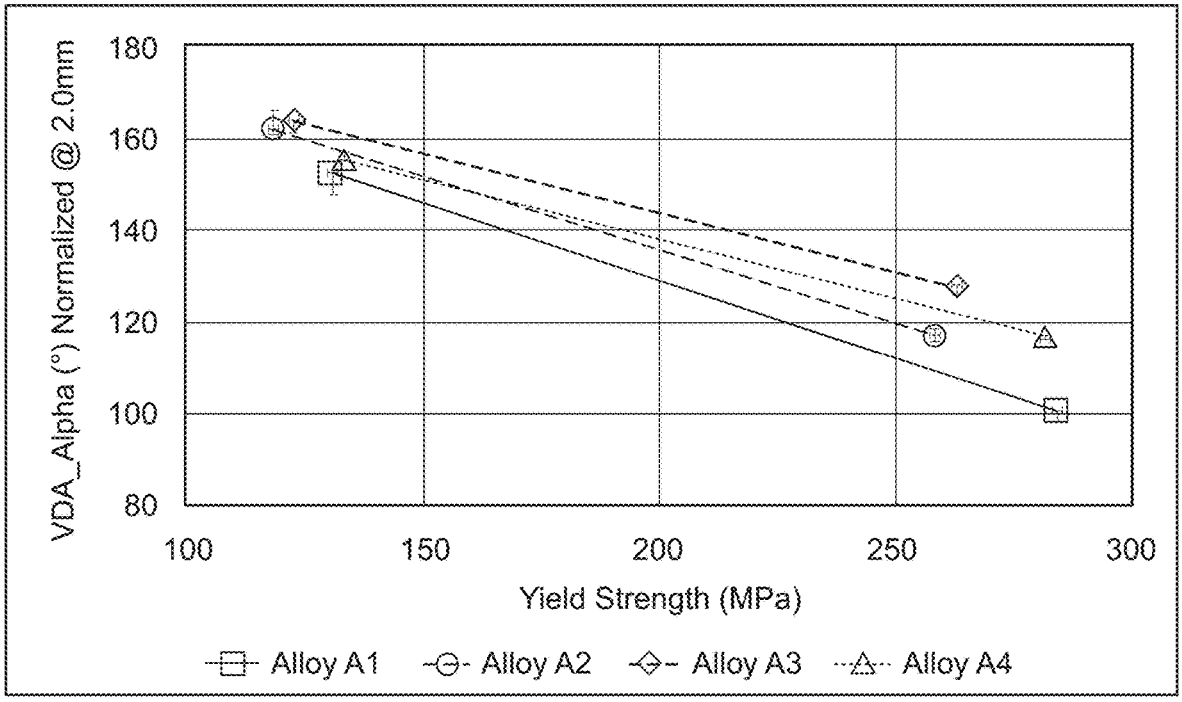
FIG. 1 shows the yield strength and the VDA angle of the bendability test for four alloys (A1-A4), each of which was prepared in the T4 and T6 tempers.

The present disclosure provides novel 6xxx series aluminum alloys and methods of making and using such alloys. These alloys exhibit high strength and corrosion resistance. Surprisingly, these alloys include additional amounts of one or more minor alloying elements (e.g., manganese, chromium, zirconium, vanadium, etc.) whose presence acts to reduce the precipitation of silicon and/or copper at the grain boundaries. Thus, the inclusion of these minor alloying elements results in high-strength aluminum alloys containing copper and/or excess silicon without suffering decreased corrosion resistance due to the precipitation of these elements at the grain boundaries.

Definitions and Descriptions

The terms "invention," "the invention," "this invention," and "the present invention" used herein are intended to refer broadly to all of the subject matter of this patent application and the claims below. Statements containing these terms should be understood not to limit the subject matter described herein or to limit the meaning or scope of the patent claims below.

In this description, reference is made to alloys identified by AA numbers and other related designations, such as "series" or "6xxx." For an understanding of the number designation system most commonly used in naming and identifying aluminum and its alloys, see "International Alloy Designations and Chemical Composition Limits for Wrought Aluminum and Wrought Aluminum Alloys" or "Registration Record of Aluminum Association Alloy Designations and Chemical Compositions Limits for Aluminum Alloys in the Form of Castings and Ingot," both published by The Aluminum Association.

As used herein, the meaning of "a," "an," and "the" includes singular and plural references unless the context clearly dictates otherwise.

As used herein, a plate generally has a thickness of greater than about 15 mm. For example, a plate may refer to an aluminum product having a thickness of greater than 15 mm, greater than 20 mm, greater than 25 mm, greater than 30 mm, greater than 35 mm, greater than 40 mm, greater than 45 mm, greater than 50 mm, or greater than 100 mm.

As used herein, a shate (also referred to as a sheet plate) generally has a thickness of from about 4 mm to about 15 mm. For example, a shate may have a thickness of 4 mm, 5 mm, 6 mm, 7 mm, 8 mm, 9 mm, 10 mm, 11 mm, 12 mm, 13 mm, 14 mm, or 15 mm.

As used herein, a sheet generally refers to an aluminum product having a thickness of less than about 4 mm. For example, a sheet may have a thickness of less than 4 mm, less than 3 mm, less than 2 mm, less than 1 mm, less than 0.5 mm, less than 0.3 mm, or less than 0.1 mm.

Reference is made in this application to alloy temper or condition. For an understanding of the alloy temper descriptions most commonly used, see "American National Standards (ANSI) H35 on Alloy and Temper Designation Systems." An F condition or temper refers to an aluminum alloy as fabricated. An O condition or temper refers to an aluminum alloy after annealing. A T1 condition or temper refers to an aluminum alloy cooled from hot working and naturally aged (e.g., at room temperature). A T2 condition or temper refers to an aluminum alloy cooled from hot working, cold worked and naturally aged. A T3 condition or temper refers to an aluminum alloy solution heat treated, cold worked, and naturally aged. A T4 condition or temper refers to an aluminum alloy solution heat treated and naturally aged. A T5 condition or temper refers to an aluminum alloy cooled from hot working and artificially aged (at elevated temperatures). A T6 condition or temper refers to an aluminum alloy solution heat treated and artificially aged. A T7 condition or temper refers to an aluminum alloy solution heat treated and artificially overaged. A T8 condition or temper refers to an aluminum alloy solution heat treated, cold worked, and artificially aged. A T9 condition or temper refers to an aluminum alloy solution heat treated, artificially aged, and cold worked.

As used herein, terms such as "cast metal product," "cast product," "cast aluminum alloy product," and the like are interchangeable and refer to a product produced by direct chill casting (including direct chill co-casting) or semi-continuous casting, continuous casting (including, for example, by use of a twin belt caster, a twin roll caster, a block caster, or any other continuous caster), electromagnetic casting, hot top casting, or any other casting method.

As used herein, the meaning of "room temperature" can include a temperature of from about 15° C. to about 30° C., for example about 15° C., about 16° C., about 17° C., about 18° C., about 19° C., about 20° C., about 21° C., about 22° C., about 23° C., about 24° C., about 25° C., about 26° C., about 27° C., about 28° C., about 29° C., or about 30° C.

All ranges disclosed herein are to be understood to encompass any and all subranges subsumed therein. For example, a stated range of "1 to 10" should be considered to include any and all subranges between (and inclusive of) the minimum value of 1 and the maximum value of 10; that is, all subranges beginning with a minimum value of 1 or more, e.g. 1 to 6.1, and ending with a maximum value of 10 or less, e.g., 5.5 to 10.

In the following examples, the aluminum alloys are described in terms of their elemental composition in percent by weight (wt. %). In each alloy, the remainder is aluminum if not otherwise indicated. In some examples, the alloys disclosed herein have a maximum percent by weight of 0.15% for the sum of all impurities.

Alloy Composition

The alloys described herein are novel 6xxx series aluminum alloys. The aluminum alloys exhibit high yield strength and bendability, coupled with unexpectedly high corrosion resistance at the grain boundaries. The properties of the aluminum alloys are achieved due to the compositions and/or methods of making the alloys.

In some examples, the aluminum alloy has the elemental composition set forth in Table 1.

TABLE 1

| Element | Weight Percentage (wt. %) |
|---|---|
| Si | 0.2-1.5 |
| Mg | 0.4-1.6 |
| Cu | 0.2-1.5 |
| Fe | 0-0.5 |
| Ti | 0-0.1 |
| Cr | 0.04-1.0 |
| Zr | 0-0.05 |
| Mn | 0-0.25 |
| V | 0-0.05 |
| Others | 0-0.2 (each) |
| | 0-0.5 (total) |
| Al | Remainder (at least 95.0) |

In some examples, the aluminum alloy has the elemental composition set forth in Table 2.

TABLE 2

| Element | Weight Percentage (wt. %) |
|---|---|
| Si | 0.2-1.5 |
| Mg | 0.4-1.6 |
| Cu | 0.2-1.5 |
| Fe | 0-0.5 |
| Ti | 0-0.1 |
| Cr | 0-0.1 |
| Zr | 0.02-0.2 |
| Mn | 0-0.25 |
| V | 0-0.05 |
| Others | 0-0.2 (each) |
| | 0-0.5 (total) |
| Al | Remainder (at least 95.0) |

In some examples, the aluminum alloy has the elemental composition set forth in Table 3.

TABLE 3

| Element | Weight Percentage (wt. %) |
|---|---|
| Si | 0.2-1.5 |
| Mg | 0.4-1.6 |
| Cu | 0.2-1.5 |
| Fe | 0-0.5 |
| Ti | 0-0.1 |
| Cr | 0-0.1 |
| Zr | 0-0.05 |
| Mn | 0.1-0.6 |
| V | 0-0.05 |
| Others | 0-0.2 (each) |
| | 0-0.5 (total) |
| Al | Remainder (at least 95.0) |

In some examples, the aluminum alloy has the elemental composition set forth in Table 4.

TABLE 4

| Element | Weight Percentage (wt. %) |
|---|---|
| Si | 0.2-1.5 |
| Mg | 0.4-1.6 |
| Cu | 0.2-1.5 |
| Fe | 0-0.5 |
| Ti | 0-0.1 |
| Cr | 0-0.1 |
| Zr | 0-0.05 |
| Mn | 0-0.25 |
| V | 0.05-0.2 |
| Others | 0-0.2 (each) |
| | 0-0.5 (total) |
| Al | Remainder (at least 95.0) |

In some examples, the alloy compositions described herein include from about 0.2% to about 1.5% silicon (Si). For example, the alloy compositions can include Si in an amount of from about 0.3% to about 1.1%, from about 0.4% to about 1.0%, from about 0.4% to about 0.9% Si, from about 0.4% to about 0.8%, or from about 0.4% to about 0.7%. In some examples, the alloy compositions can include about 0.2%, about 0.3%, about 0.4%, about 0.5%, about 0.6%, about 0.7%, about 0.8%, about 0.9%, about 1.0%, about 1.1%, about 1.2% Si, about 1.3% Si, about 1.4% Si, or about 1.5% Si. All percentages are expressed in wt. %.

In some examples, the alloy compositions described herein include from about 0.4% to about 1.6% magnesium (Mg). For example, the alloy compositions can include Mg in an amount of from about 0.4% to about 1.2%, from about 0.4% to about 1.0%, from about 0.5% to about 1.2%, from about 0.5% to about 1.0%, or from about 0.4% to about 0.7% Mg. In some examples, the alloy compositions can include about 0.4%, about 0.5%, about 0.6%, about 0.7%, about 0.8%, about 0.9%, about 1.0%, about 1.1%, about 1.2%, about 1.3%, about 1.4% Mg, or about 1.5% Mg. All percentages are expressed in wt. %.

In some examples, the alloy compositions described herein include from about 0.2% to about 1.5% copper (Cu). For example, the alloy compositions can include Cu in an amount of from about 0.3% to about 1.1%, from about 0.4% to about 1.0%, from about 0.4% to about 0.9%, from about 0.4% to about 0.8%, or from about 0.4% to about 0.7%. In some examples, the alloy compositions can include about 0.2%, about 0.3%, about 0.4%, about 0.5%, about 0.6%, about 0.7%, about 0.8%, about 0.9%, about 1.0%, about 1.1%, about 1.2% Cu, about 1.3% Cu, about 1.4% Cu, or about 1.5% Cu. All percentages are expressed in wt. %.

In some examples, the alloy compositions described herein include up to about 0.5% iron (Fe). For example, the alloy compositions can include Fe in an amount of from 0% to about 0.4%, from 0% to about 0.3%, from about 0.1% to about 0.5%, or from about 0.1% to about 0.3%. In some examples, the alloy compositions can include about 0.1%, about 0.2%, about 0.3%, about 0.4%, or about 0.5% Fe. In some cases, Fe is not present in the alloy (i.e., 0%). All percentages are expressed in wt. %.

In some examples, the alloy compositions described herein include up to about 0.1% titanium (Ti). For example, the alloy compositions can include Ti in an amount of from 0% to about 0.07%, from 0% to about 0.05%, from about 0.01% to about 0.1%, from about 0.01% to about 0.07%, or from about 0.01% to about 0.05%. In some examples, the alloy compositions can include about 0.01%, about 0.02%, about 0.03%, about 0.04%, about 0.05%, about 0.06%, about 0.07%, about 0.08%, about 0.09%, or about 0.10%. In some cases, Ti is not present in the alloy (i.e., 0%). All percentages are expressed in wt. %.

In some examples disclosed herein, such as those set forth in Table 1, the alloy composition has an excess of chromium (Cr) above what may be typical for a 6xxx series aluminum alloy. In such cases, the alloy compositions can include from about 0.04% to about 1.0% Cr. For example, the alloy compositions can include Cr in an amount of from about 0.06% to about 0.50%, from about 0.08% to about 0.20%, from about 0.09% to about 0.20%, or from about 0.09% to about 0.15%. In some cases, the alloy compositions can include about 0.04%, about 0.05%, about 0.06%, about 0.07%, about 0.08%, about 0.09%, about 0.10%, about 0.11%, about 0.12%, about 0.13%, about 0.14%, about 0.15%, about 0.16%, about 0.17%, about 0.18%, about 0.19%, about 0.20%, about 0.21%, about 0.22%, about 0.23%, about 0.24%, about 0.25%, about 0.26%, about 0.27%, about 0.28%, about 0.29%, about 0.30%, about 0.31%, about 0.32%, about 0.33%, about 0.34%, about 0.35%, about 0.36%, about 0.37%, about 0.38%, about 0.39%, about 0.40%, about 0.41%, about 0.42%, about 0.43%, about 0.44%, about 0.45%, about 0.46%, about 0.47%, about 0.48%, about 0.49%, about 0.50%, about 0.51%, about 0.52%, about 0.53%, about 0.54%, about 0.55%, about 0.56%, about 0.57%, about 0.58%, about 0.59%, about 0.60%, about 0.61%, about 0.62%, about 0.63%, about 0.64%, about 0.65%, about 0.66%, about 0.67%, about 0.68%, about 0.69%, about 0.70%, about 0.71%, about 0.72%, about 0.73%, about 0.74%, about 0.75%, about 0.76%, about 0.77%, about 0.78%, about 0.79%, about 0.80%, about 0.81%, about 0.82%, about 0.83%, about 0.84%, about 0.85%, about 0.86%, about 0.87%, about 0.88%, about 0.89%, about 0.90%, about 0.91%, about 0.92%, about 0.93%, about 0.94%, about 0.95%, about 0.96%, about 0.97%, about 0.98%, about 0.99%, or about 1.0% Cr. All percentages are expressed in wt. %.

In some other examples disclosed herein, such as those set forth in Tables 2-4, the alloy compositions can have lower amounts of Cr. In such examples, the alloy compositions can include from 0 to about 0.1% Cr. In some examples, the alloy compositions can include Cr in an amount of from 0% to about 0.07%, from 0% to about 0.05%, from about 0.01% to about 0.1%, from about 0.01% to about 0.07%, or from about 0.01 to about 0.05%. In some such cases, the alloy compositions can include about 0.01%, about 0.02%, about 0.03%, about 0.04%, about 0.05%, about 0.06%, about 0.07%, about 0.08%, about 0.09%, or about 0.10% Cr. In some cases, Cr is not present in the alloy (i.e., 0%). All percentages are expressed in wt. %.

In some examples disclosed herein, such as those set forth in Table 2, the alloy composition has an excess of zirconium (Zr) above what may be typical for a 6xxx series aluminum alloy. For example, the alloy compositions can include from about 0.02% to about 0.20% Zr. In some examples, the alloy compositions can include Zr in an amount of from about 0.04% to about 0.18%, from about 0.06% to about 0.16%, from about 0.07% to about 0.16%, or from about 0.08% to about 0.16%. In some such cases, the alloy compositions can include about 0.02%, about 0.03%, about 0.04%, about 0.05%, about 0.06%, about 0.07%, about 0.08%, about 0.09%, about 0.10%, about 0.11%, about 0.12%, about 0.13%, about 0.14%, about 0.15%, about 0.16%, about 0.17%, about 0.18%, about 0.19%, or about 0.20% Zr. All percentages are expressed in wt. %.

In some other examples disclosed herein, such as those set forth in Tables 1, 3, and 4, the alloy compositions can include lower amounts of Zr. In such examples, the alloy compositions can have from 0% to about 0.05% Zr. In some examples, the alloy compositions can include Zr in an amount of from 0% to about 0.04%, from 0% to about 0.03%, from about 0.01% to about 0.05%, from about 0.01% to about 0.04%, or from about 0.01% to about 0.03%. In some such cases, the alloy compositions can include about 0.01%, about 0.02%, about 0.03%, about 0.04%, or about 0.05% Zr. In some cases, Zr is not present in the alloy (i.e., 0%). All percentages are expressed in wt. %.

In some examples disclosed herein, such as those set forth in Table 3, the alloy composition has an excess of manganese (Mn) above what may be typical for a 6xxx series aluminum alloy. In such examples, the alloy compositions can include Mn in an amount of from about 0.1% to about 1.0%, from about 0.1% to about 0.6%, or from about 0.25% to about 1.0%. In some examples, the alloy compositions have include Mn in an amount of from about 0.2% to about 1.0%, from about 0.4% to about 1.0%, from about 0.1% to about 0.8%, from about 0.2% to about 0.8%, from about 0.3% to about 0.8%, from about 0.2% to about 0.6%, or from about 0.3% to about 0.6%. In some such cases, the alloy compositions can include about 0.10%, about 0.11%, about 0.12%, about 0.13%, about 0.14%, about 0.15%, about 0.16%, about 0.17%, about 0.18%, about 0.19%, about 0.20%, about 0.21%, about 0.22%, about 0.23%, about 0.24%, about 0.25%, about 0.26%, about 0.27%, about 0.28%, about 0.29%, about 0.30%, about 0.31%, about 0.32%, about 0.33%, about 0.34%, about 0.35%, about 0.36%, about 0.37%, about 0.38%, about 0.39%, about 0.40%, about 0.41%, about 0.42%, about 0.43%, about 0.44%, about 0.45%, about 0.46%, about 0.47%, about 0.48%, about 0.49%, about 0.50%, about 0.51%, about 0.52%, about 0.53%, about 0.54%, about 0.55%, about 0.56%, about 0.57%, about 0.58%, about 0.59%, about 0.60%, about 0.61%, about 0.62%, about 0.63%, about 0.64%, about 0.65%, about 0.66%, about 0.67%, about 0.68%, about 0.69%, about 0.70%, about 0.71%, about 0.72%, about 0.73%, about 0.74%, about 0.75%, about 0.76%, about 0.77%, about 0.78%, about 0.79%, about 0.80%, about 0.81%, about 0.82%, about 0.83%, about 0.84%, about 0.85%, about 0.86%, about 0.87%, about 0.88%, about 0.89%, about 0.90%, about 0.91%, about 0.92%, about 0.93%, about 0.94%, about 0.95%, about 0.96%, about 0.97%, about 0.98%, about 0.99%, or about 1.0 Mn. All percentages are expressed in wt. %.

In some other examples disclosed herein, such as those set forth in Tables 1, 2, and 4, the alloy compositions have lower amounts of Mn. In such examples, the alloy compositions can have from 0% to about 0.25% Mn. In some examples, the alloy compositions can include Mn in an amount of from 0% to about 0.23%, from 0% to about 0.21%, from about 0.05% to about 0.23%, from about 0.05% to about 0.21%, or from about 0.10% to about 0.23%. In some such cases, the alloy compositions can include about 0.01%, about 0.02%, about 0.03%, about 0.04%, about 0.05%, about 0.06%, about 0.07%, about 0.08%, about 0.09%, about 0.10%, about 0.11%, about 0.12%, about 0.13%, about 0.14%, about 0.15%, about 0.16%, about 0.17%, about 0.18%, about 0.19%, about 0.20%, about 0.21%, about 0.22%, about 0.23%, about 0.24%, or about 0.25% Mn. In some cases, Mn is not present in the alloy (i.e., 0%). All percentages are expressed in wt. %.

In some examples disclosed herein, such as those set forth in Table 4, the alloy composition has an excess of vanadium (V) above what may be typical for a 6xxx series alloy. In such examples, the alloy compositions can include V in an amount of from about 0.05% to about 0.20%. In some examples, the alloy compositions can include V in an amount of from about 0.07% to about 0.20%, from about 0.09% to about 0.20%, or from about 0.11% to about 0.20%. In some such cases, the alloy compositions can include about 0.05%, about 0.06%, about 0.07%, about 0.08%, about 0.09%, about 0.10%, about 0.11%, about 0.12%, about 0.13%, about 0.14%, about 0.15%, about 0.16%, about 0.17%, about 0.18%, about 0.19%, or about 0.20% V. All percentages are expressed in wt. %.

In some other examples disclosed herein, such as those set forth in Tables 1-3, the alloy compositions can have lower amounts of V. In such examples, the alloy compositions can have from 0% to about 0.05% V. In some examples, the alloy compositions can include V in an amount of from 0% to about 0.04%, from 0% to about 0.03%, from about 0.01% to about 0.05%, from about 0.01% to about 0.04%, or from about 0.01% to about 0.03%. In some such cases, the alloy compositions can include about 0.01%, about 0.02%, about 0.03%, about 0.04%, or about 0.05%. In some cases, V is not present in the alloy (i.e., 0%). All percentages are expressed in wt. %.

Optionally, the alloy compositions disclosed herein can have minor amounts of other elements, including, but not limited to, scandium (Sc), tin (Sn), zinc (Zn), and nickel (Ni).

In some examples, the alloy compositions can include Sc in an amount of from 0% to 0.20%, from 0% to about 0.15%, or from 0% to about 0.10%. In some such examples, the alloy compositions can include about 0.01%, about 0.02%, about 0.03%, about 0.04%, about 0.05%, about 0.06%, about 0.07%, about 0.08%, about 0.09%, about 0.10%, about 0.11%, about 0.12%, about 0.13%, about 0.14%, about 0.15%, about 0.16%, about 0.17%, about 0.18%, about 0.19%, or about 0.20% Sc. In some cases, Sc is not present in the alloy (i.e., 0%). All percentages are expressed in wt. %.

In some examples, the alloy compositions can include Sn in an amount of from 0% to 0.20%, from 0% to about 0.15%, or from 0% to about 0.10%. In some such examples, the alloy compositions can include about 0.01%, about 0.02%, about 0.03%, about 0.04%, about 0.05%, about 0.06%, about 0.07%, about 0.08%, about 0.09%, about 0.10%, about 0.11%, about 0.12%, about 0.13%, about 0.14%, about 0.15%, about 0.16%, about 0.17%, about 0.18%, about 0.19%, or about 0.20% Sn. In some cases, Sn is not present in the alloy (i.e., 0%). All percentages are expressed in wt. %.

In some examples, the alloy compositions can include Zn in an amount of from 0% to 0.20%, from 0% to about 0.15%, or from 0% to about 0.10%. In some such examples, the alloy compositions can include about 0.01%, about 0.02%, about 0.03%, about 0.04%, about 0.05%, about 0.06%, about 0.07%, about 0.08%, about 0.09%, about 0.10%, about 0.11%, about 0.12%, about 0.13%, about 0.14%, about 0.15%, about 0.16%, about 0.17%, about 0.18%, about 0.19%, or about 0.20% Zn. In some cases, Zn is not present in the alloy (i.e., 0%). All percentages are expressed in wt. %.

In some examples, the alloy compositions can include Ni in an amount of from 0% to 0.20%, from 0% to about 0.15%, or from 0% to about 0.10%. In some such examples, the alloy compositions can include about 0.01%, about 0.02%, about 0.03%, about 0.04%, about 0.05%, about 0.06%, about 0.07%, about 0.08%, about 0.09%, about 0.10%, about 0.11%, about 0.12%, about 0.13%, about 0.14%, about 0.15%, about 0.16%, about 0.17%, about 0.18%, about 0.19%, or about 0.20% Ni. In some cases, Ni is not present in the alloy (i.e., 0%). All percentages are expressed in wt. %.

In some examples, the alloys disclosed herein can include one or more of certain rare earth elements (i.e., one or more of Y, La, Ce, Pr, Nd, Pm, Sm, Eu, Gd, Tb, Dy, Ho, Er, Tm, Yb, and Lu) in an amount of up to about 0.10% (e.g., from about 0.01% to about 0.10%, from about 0.01% to about 0.05%, or from about 0.03% to about 0.05%) based on the total weight of the alloy. For example, the alloy can include about 0.01%, about 0.02%, about 0.03%, about 0.04%, about 0.05%, about 0.06%, about 0.07%, about 0.08%, about 0.09%, or about 0.10% of the rare earth elements. All percentages are expressed in wt. %.

In some examples, the alloys disclosed herein can include one or more of Mo, Nb, Be, B, Co, Sr, In, Hf, and Ag in an amount of up to about 0.10% (e.g., from about 0.01% to about 0.10%, from about 0.01% to about 0.05%, or from about 0.03% to about 0.05%) based on the total weight of the alloy. For example, the alloy can include about 0.01%, about 0.02%, about 0.03%, about 0.04%, about 0.05%, about 0.06%, about 0.07%, about 0.08%, about 0.09%, or about 0.10% of one or more of Mo, Nb, Be, B, Co, Sr, In, Hf, and Ag. All percentages are expressed in wt. %.

Optionally, the alloy compositions disclosed herein, including those set forth in Tables 1-4, can further include other minor elements, sometimes referred to as impurities, in amounts of 0.05% or below, 0.04% or below, 0.03% or below, 0.02% or below, or 0.01% or below. These impurities may include, but are not limited to Ga, Ca, Bi, Na, Pb, or combinations thereof. Accordingly, Ga, Ca, Bi, Na, or Pb may be present in alloys in amounts of 0.05% or below, 0.04% or below, 0.03% or below, 0.02% or below, or 0.01% or below. The sum of all impurities does not exceed 0.15% (e.g., 0.10%). All percentages are expressed in wt. %.

The alloy compositions disclosed herein have aluminum (Al) as a major component, typically in an amount of at least 95.0%. In some examples, the alloy compositions have at least 95.5%, at least 96.0%, at least 96.5%, at least 97.0%, or at least 97.5% Al.

Methods of Preparing Aluminum Alloy Products

In certain aspects, the disclosed alloy compositions are a product of a disclosed method. Without intending to limit the invention, aluminum alloy properties are partially determined by the formation of microstructures during the alloy's preparation.

The alloys described herein can be cast using a casting method as known to those of skill in the art. For example, the casting process can include a direct chill (DC) casting process. Optionally, DC cast aluminum alloy products (e.g., ingots) can be scalped before subsequent processing. Optionally, the casting process can include a continuous casting (CC) process. The cast aluminum alloy products can then be subjected to further processing steps. In one non-limiting example, the processing method includes homogenization, hot rolling, solutionization, and quenching. In some cases, the processing steps further include annealing and/or cold rolling if desired.

Homogenization

The homogenization step can include heating an aluminum alloy product prepared from an alloy composition described herein to attain a peak metal temperature (PMT) of at least about 450° C. (e.g., at least about 450° C., at least about 460° C., at least about 470° C., at least about 480° C., at least about 490° C., at least about 500° C., at least about 510° C., at least about 520° C., at least about 530° C., at least about 540° C., at least about 550° C., at least about 560° C., at least about 570° C., or at least about 580° C.). For example, the aluminum alloy product can be heated to a temperature of from about 520° C. to about 580° C., from about 530° C. to about 575° C., from about 535° C. to about 570° C., from about 540° C. to about 565° C., from about 545° C. to about 560° C., from about 530° C. to about 560° C., or from about 550° C. to about 580° C. In some cases, the heating rate to the PMT can be about 100° C./hour or less, 75° C./hour or less, 50° C./hour or less, 40° C./hour or less, 30° C./hour or less, 25° C./hour or less, 20° C./hour or less, or 15° C./hour or less. In other cases, the heating rate to the PMT can be from about 10° C./min to about 100° C./min (e.g., about 10° C./min to about 90° C./min, about 10° C./min to about 70° C./min, about 10° C./min to about 60° C./min, from about 20° C./min to about 90° C./min, from about 30° C./min to about 80° C./min, from about 40° C./min to about 70° C./min, or from about 50° C./min to about 60° C./min).

The aluminum alloy product is then allowed to soak (i.e., held at the indicated temperature) for a period of time. According to one non-limiting example, the aluminum alloy product is allowed to soak for up to about 6 hours (e.g., from about 30 minutes to about 6 hours, inclusively). For example, the aluminum alloy product can be soaked at a temperature of at least 500° C. for 30 minutes, 1 hour, 2 hours, 3 hours, 4 hours, 5 hours, or 6 hours, or anywhere in between.

Hot Rolling

Following the homogenization step, a hot rolling step can be performed. In certain cases, the aluminum alloy products are laid down and hot-rolled with an entry temperature range of about 500° C.-540° C. The entry temperature can be, for example, about 505° C., 510° C., 515° C., 520° C., 525° C., 530° C., 535° C., or 540° C. In certain cases, the hot roll exit temperature can range from about 250° C.-380° C. (e.g., from about 330° C.-370° C.). For example, the hot roll exit temperature can be about 255° C., 260° C., 265° C., 270° C., 275° C., 280° C., 285° C., 290° C., 295° C., 300° C., 305° C., 310° C., 315° C., 320° C., 325° C., 330° C., 335° C., 340° C., 345° C., 350° C., 355° C., 360° C., 365° C., 370° C., 375° C., or 380° C.

In certain cases, the homogenized samples were plunged cooled from 560° C. to 350° C. (e.g., to below the recrystallization temperature) using a room temperature water spray. The samples were then hot rolled at a hot rolling entry temperature between 340° C. to 360° C. to suppress the precipitation of solute elements (e.g., Mg, Si, Cu etc.). The relatively low hot rolling temperature helped to keep the sheet unrecrystallized and maximize stored energy from the rolling process. The finishing hot rolling temperature was between 270° C. and 310° C. Immediately following hot rolling, the samples were water quenched immediately without any time delay at the exit of the hot mill, with room temperature water. The immediate quenching with room temperature water was performed to avoid grain boundary precipitation in the samples and to maximize the amount of solute elements in solid solution that would precipitate out as a strengthening phase during artificial aging.

In certain examples, the aluminum alloy product is hot rolled to an about 4 mm to about 15 mm thick gauge (e.g., from about 5 mm to about 12 mm thick gauge), which is referred to as a shate. For example, the aluminum alloy product can be hot rolled to an about 15 mm thick gauge, about 14 mm thick gauge, about 13 mm thick gauge, about 12 mm thick gauge, about 11 mm thick gauge, about 10 mm thick gauge, about 9 mm thick gauge, about 8 mm thick gauge, about 7 mm thick gauge, about 6 mm thick gauge, or about 5 mm thick gauge.

In other examples, the aluminum alloy product can be hot rolled to a gauge greater than 15 mm thick (i.e., a plate). For example, the aluminum alloy product can be hot rolled to an about 25 mm thick gauge, about 24 mm thick gauge, about 23 mm thick gauge, about 22 mm thick gauge, about 21 mm thick gauge, about 20 mm thick gauge, about 19 mm thick gauge, about 18 mm thick gauge, about 17 mm thick gauge, or about 16 mm thick gauge.

In other cases, the aluminum alloy product can be hot rolled to a gauge less than 4 mm (i.e., a sheet). In some examples, the aluminum alloy product is hot rolled to an about 1 mm to about 4 mm thick gauge. For example, the aluminum alloy product can be hot rolled to an about 4 mm thick gauge, about 3 mm thick gauge, about 2 mm thick gauge, about 1 mm thick gauge.

The temper of the as-rolled plates, shates, and sheets is referred to as F-temper.

Optional Processing Steps: Annealing Step and Cold Rolling Step

In certain aspects, the alloy undergoes further processing steps after the hot rolling step and before any subsequent steps (e.g., before a solutionizing step). Further process steps may include an annealing procedure and a cold rolling step.

The annealing step can result in an alloy with improved texture components (e.g., an improved T4 alloy) with reduced anisotropy during forming operations, such as stamping, drawing, or bending. By applying the annealing step, the texture in the modified temper is controlled/engineered to be more random and to reduce those texture components (TCs) that can yield strong formability anisotropy (e.g., Goss, Goss-ND, or Cube-RD). This improved texture can potentially reduce the bending anisotropy and can improve the formability in the forming where a drawing or circumferential stamping process is involved, as it acts to reduce the variability in properties at different directions.

The annealing step can include heating the alloy from room temperature to a temperature from about 400° C. to about 500° C. (e.g., from about 405° C. to about 495° C., from about 410° C. to about 490° C., from about 415° C. to about 485° C., from about 420° C. to about 480° C., from about 425° C. to about 475° C., from about 430° C. to about 470° C., from about 435° C. to about 465° C., from about 440° C. to about 460° C., from about 445° C. to about 455° C., from about 450° C. to about 460° C., from about 400° C. to about 450° C., from about 425° C. to about 475° C., or from about 450° C. to about 500° C.).

The aluminum alloy product (e.g., plate, shate, or sheet) can soak at the temperature for a period of time. In one non-limiting example, the aluminum alloy product is allowed to soak for up to approximately 2 hours (e.g., from about 15 to about 120 minutes, inclusively). For example, the aluminum alloy product can be soaked at the temperature of from about 400° C. to about 500° C. for 15 minutes, 20 minutes, 25 minutes, 30 minutes, 35 minutes, 40 minutes, 45 minutes, 50 minutes, 55 minutes, 60 minutes, 65 minutes, 70 minutes, 75 minutes, 80 minutes, 85 minutes, 90 minutes, 95 minutes, 100 minutes, 105 minutes, 110 minutes, 115 minutes, or 120 minutes, or anywhere in between.

In certain aspects, the alloy does not undergo an annealing step.

A cold rolling step can optionally be applied to the alloy before the solutionizing step. In some examples, the rolled product from the hot rolling step (e.g., the plate, shate, or sheet) can be cold rolled to a thin gauge shate (e.g., about 4.0 to 4.5 mm). In other examples, the rolled product is cold rolled to about 4.5 mm, about 4.4 mm, about 4.3 mm, about 4.2 mm, about 4.1 mm, or about 4.0 mm. In other examples, the rolled product is rolled to about 3.9 mm, about 3.8 mm, about 3.7 mm, about 3.6 mm, about 3.5 mm, about 3.4 mm, about 3.3 mm, about 3.2 mm, about 3.1 mm, about 3.0 mm, about 2.9 mm, about 2.8 mm, about 2.7 mm, about 2.6 mm, about 2.5 mm, about 2.4 mm, about 2.3 mm, about 2.2 mm, about 2.1 mm, about 2.0 mm, about 1.9 mm, about 1.8 mm, about 1.7 mm, about 1.6 mm, about 1.5 mm, about 1.4 mm, about 1.3 mm, about 1.2 mm, about 1.1 mm, or about 1.0 mm.

Solutionizing

The solutionizing step can include heating the aluminum alloy product from room temperature to a temperature of from about 520° C. to about 590° C. (e.g., from about 520° C. to about 580° C., from about 530° C. to about 570° C., from about 545° C. to about 575° C., from about 550° C. to about 570° C., from about 555° C. to about 565° C., from about 540° C. to about 560° C., from about 560° C. to about 580° C., or from about 550° C. to about 575° C.). The aluminum alloy product can soak at the temperature for a period of time. In certain aspects, the aluminum alloy product is allowed to soak for up to approximately 2 hours (e.g., from about 10 seconds to about 120 minutes inclusively). For example, the aluminum alloy product can be soaked at the temperature of from about 525° C. to about 590° C. for 20 seconds, 25 seconds, 30 seconds, 35 seconds, 40 seconds, 45 seconds, 50 seconds, 55 seconds, 60 seconds, 65 seconds, 70 seconds, 75 seconds, 80 seconds, 85 seconds, 90 seconds, 95 seconds, 100 seconds, 105 seconds, 110 seconds, 115 seconds, 120 seconds, 125 seconds, 130 seconds, 135 seconds, 140 seconds, 145 seconds, or 150 seconds, 5 minutes, 10 minutes, 15 minutes, 20 minutes, 25 minutes, 30 minutes, 35 minutes, 40 minutes, 45 minutes, 50 minutes, 55 minutes, 60 minutes, 65 minutes, 70 minutes, 75 minutes, 80 minutes, 85 minutes, 90 minutes, 95 minutes, 100 minutes, 105 minutes, 110 minutes, 115 minutes, or 120 minutes, or anywhere in between.

In certain aspects, the solutionizing heat treatment is performed immediately after the hot or cold rolling step. In certain aspects, the solutionizing heat treatment is performed after an annealing step.

Quenching

In certain aspects, the aluminum alloy product can then be cooled to a temperature of about 25° C. at a quench speed that can vary between about 50° C./s to 400° C./s in a quenching step that is based on the selected gauge. For example, the quench rate can be from about 50° C./s to about 375° C./s, from about 60° C./s to about 375° C./s, from about 70° C./s to about 350° C./s, from about 80° C./s to about 325° C./s, from about 90° C./s to about 300° C./s, from about 100° C./s to about 275° C./s, from about 125° C./s to about 250° C./s, from about 150° C./s to about 225° C./s, or from about 175° C./s to about 200° C./s.

In the quenching step, the aluminum alloy product is rapidly quenched with a liquid (e.g., water) and/or gas or another selected quench medium. In certain aspects, the aluminum alloy product can be rapidly quenched with water. In certain aspects, the aluminum alloy product is quenched with air.

Aging

The aluminum alloy product can be naturally aged for a period of time to result in the T4 temper. In certain aspects, the aluminum alloy product in the T4 temper can be artificially aged (AA) at about 180° C. to 225° C. (e.g., 185° C., 190° C., 195° C., 200° C., 205° C., 210° C., 215° C., 220° C., or 225° C.) for a period of time to results a T6 temper. Optionally, the aluminum alloy product can be cold worked and artificially aged for a period from about 15 minutes to about 8 hours (e.g., 15 minutes, 30 minutes, 1 hour, 2 hours, 3 hours, 4 hours, 5 hours, 6 hours, 7 hours, or 8 hours or anywhere in between) to result in a T8 temper.

Coil Production

The annealing step during production can also be applied to produce the aluminum alloy product in a coil form for improved productivity or formability. For example, an aluminum alloy product in coil form can be supplied in the O temper, using a hot or cold rolling step and an annealing step following the hot or cold rolling step. Forming may occur in O temper, which is followed by solution heat treatment, quenching and artificial aging/paint baking.

In certain aspects, to produce an aluminum alloy product in coil form and with high formability compared to F temper, an annealing step as described herein can be applied to the coil. Without intending to limit the invention, the purpose for the annealing and the annealing parameters may include (1) releasing the work-hardening in the material to gain formability; (2) recrystallizing or recovering the material without causing significant grain growth; (3) engineering or converting texture to be appropriate for forming and for reducing anisotropy during formability; and (4) avoiding the coarsening of pre-existing precipitation particles.

Aluminum Products and Properties Thereof

In some non-limiting examples, aluminum alloy products including the aluminum alloys disclosed herein have high yield strength and bendability and excellent corrosion resistance compared to conventional 6xxx series alloys.

In some examples, an aluminum alloy sheet prepared from the alloys disclosed herein has a tensile yield strength of at least about 265 MPa, where the sheet is in the T6 temper and the tensile yield strength is measured according to ASTM Test No. B557 (2015) with 2" GL. For example, the yield strength may be at least about 275 MPa, or at least about 280 MPa. In some other examples, the yield strength ranges from about 265 MPa to about 400 MPa, or from about 270 MPa to about 375 MPa, or from about 275 MPa to about 350 MPa.

An aluminum alloy sheet prepared from the alloys disclosed herein can have a bend angle of at least 55°, where the aluminum alloy sheet is in the T6 temper and the bend angle is measured according to the test set forth in Verband der Automobilindustrie (VDA) Test No. 238-100, with the exception that the test was performed without prestraining. In some cases, the aluminum alloy sheet has a bend angle of at least 56°, at least 57°, at least 58°, at least 59°, at least 60°, at least 61°, or at least 62°. In some other examples, the aluminum alloy sheet has a bend angle ranging from 55° to 75°, from 57° to 72°, or from 60° to 70°.

Aluminum alloy sheets prepared from the alloys disclosed herein have a corrosion resistance that provides an average intergranular corrosion (IGC) attack depth of no more than about 145 μm, when measured using the ISO 11846B (1995) test with 24-hour exposure. In some further examples, aluminum alloy sheets comprised of the alloys disclosed herein have a corrosion resistance that provides an average intergranular corrosion (IGC) attack depth of no more than 140 μm, no more than 135 μm, no more than 130 μm, no more than 125 μm, no more than 120 μm, no more than 115 μm, no more than 110 μm, no more than 105 μm, no more than 100 μm, no more than 95 μm, no more than 90 μm, no more than 85 μm, no more than 80 μm, no more than 75 μm, no more than 70 μm, no more than 65 μm, no more than 60 μm, no more than 55 μm, no more than 50 μm, no more than 45 μm, no more than 40 μm, no more than 35 μm, no more than 30 μm, or no more than 25 μm.

In some examples, aluminum alloy sheets prepared from the alloys disclosed herein have a corrosion resistance that provides a maximum intergranular corrosion (IGC) attack depth of no more than about 215 μm, when measured using the ISO 11846B (1995) test with 24-hour exposure. In some further examples, aluminum alloy sheets comprised of the alloys disclosed herein have a corrosion resistance that provides a maximum intergranular corrosion (IGC) attack depth of no more than 210 μm, no more than 205 μm, no more than 200 μm, no more than 195 μm, no more than 190 μm, no more than 185 μm, no more than 180 μm, no more than 175 μm, no more than 170 μm, no more than 165 μm, no more than 160 μm, no more than 155 μm, no more than 150 μm, no more than 145 μm, no more than 140 μm, no more than 135 μm, no more than 130 μm, no more than 125 μm, no more than 120 μm, no more than 115 μm, no more than 110 μm, no more than 105 μm, no more than 100 μm, no more than 95 μm, no more than 90 μm, no more than 85 μm, no more than 80 μm, no more than 75 μm, no more than 70 μm, no more than 65 μm, no more than 60 μm, no more than 55 μm, no more than 50 μm, no more than 45 μm, no more than 40 μm, no more than 35 μm, no more than 30 μm, or no more than 25 μm.

In some further examples, aluminum alloy sheets prepared from the alloys disclosed herein have a corrosion resistance that provides a maximum intergranular corrosion (IGC) attack depth of no more than the average grain size of the grains of the tested surface, where the pit depth is measured using the ISO 11846B (1995) test with 24-hour exposure, and the average grain size is calculated measured by the ASTM E112 (2004) method. In some further examples, aluminum alloy sheets comprised of the alloys disclosed herein have a corrosion resistance that provides a maximum intergranular corrosion (IGC) attack depth of no more than 0.9 times the average grain size, no more than 0.8 times the average grain size, no more than 0.7 times the average grain size, no more than 0.6 times the average grain size, or no more than 0.5 times the average grain size.

In some further examples, aluminum alloy sheets prepared from the alloys disclosed herein have a corrosion resistance that provides an average intergranular corrosion (IGC) attack depth of no more than the average grain size of the grains of the tested surface, where the pit depth is measured using the ISO 11846B (1995) test with 24-hour exposure, and the average grain size is calculated measured by the ASTM E112 (2004) method. In some further examples, aluminum alloy sheets comprised of the alloys disclosed herein have a corrosion resistance that provides an average intergranular corrosion (IGC) attack depth of no more than 0.9 times the average grain size, no more than 0.8 times the average grain size, no more than 0.7 times the average grain size, no more than 0.6 times the average grain size, or no more than 0.5 times the average grain size.

The mechanical properties of the aluminum alloy products may be controlled by various aging conditions depending on the desired use. As one example, the aluminum alloy products can be produced (or provided) in the T4 temper, the T6 temper, or the T8 temper. T4 plates, shates or sheets, which refer to plates, shates, or sheets that are solution heat-treated and naturally aged, can be provided. These T4 plates, shates, and sheets can optionally be subjected to additional aging treatment(s) to meet strength requirements upon receipt. For example, plates, shates, and sheets can be delivered in other tempers, such as the T6 temper or the T8 temper, by subjecting the T4 alloy material to the appropriate aging treatment as described herein or otherwise known to those of skill in the art.

As disclosed in more detail above, the aluminum alloy products described herein in the form of plates, extrusions, castings, and forgings or other suitable products can be made using techniques as known to those of ordinary skill in the art. For example, plates including the aluminum alloys as described herein can be prepared by processing an aluminum alloy product in a homogenization step followed by a hot rolling step. In the hot rolling step, the aluminum alloy product can be hot rolled to a 200 mm thick gauge or less (e.g., from 1 mm to 200 mm).

Articles of Manufacture

The disclosure provides an article of manufacture that includes an aluminum alloy product disclosed herein. In some examples, the article of manufacture is comprised of a rolled aluminum alloy product. Examples of such articles of manufacture include, but are not limited to, an automobile, a truck, a trailer, a train, a railroad car, an airplane, a body panel or part for any of the foregoing, a bridge, a pipeline, a pipe, a tubing, a boat, a ship, a storage container, a storage tank, an article of furniture, a window, a door, a railing, a functional or decorative architectural piece, a pipe railing, an electrical component, a conduit, a beverage container, a food container, or a foil.

The aluminum alloy products disclosed herein can be used in automotive and/or transportation applications, including motor vehicle, aircraft, and railway applications, or any other desired application. In some examples, the aluminum alloy products disclosed herein can be used to prepare motor vehicle body part products, such as bumpers, side beams, roof beams, cross beams, pillar reinforcements (e.g., A-pillars, B-pillars, and C-pillars), inner panels, outer panels, side panels, inner hoods, outer hoods, or trunk lid panels. The aluminum alloys and methods described herein can also be used in aircraft or railway vehicle applications, to prepare, for example, external and internal panels.

The aluminum alloy products disclosed herein also can be used in electronics applications. For example, the aluminum alloy products disclosed herein can also be used to prepare housings for electronic devices, including mobile phones and tablet computers. In some examples, the alloys can be used to prepare housings for the outer casing of mobile phones (e.g., smart phones) and tablet bottom chassis.

The aluminum alloy products disclosed herein further can be used in industrial applications. For example, the aluminum alloy products disclosed herein can be used to prepare products for the general distribution market.

The following examples serve to further illustrate certain embodiments of the present disclosure without, at the same time, however, constituting any limitation thereof. On the contrary, it is to be clearly understood that resort may be had to various embodiments, modifications, and equivalents thereof which, after reading the description herein, may suggest themselves to those of ordinary skill in the art without departing from the spirit of the disclosure.

Example 1—Alloy Compositions

Five aluminum alloys (A1/Alloy 1, A2/Alloy 2, A3/Alloy 3, A4/Alloy 4, and A5/Alloy 5) were prepared, whose elemental compositions are set forth in Table 5 below. Alloys A1, A2, A3, A4, and A5 were prepared according to the methods described herein. The elemental compositions are provided in weight percentages.

TABLE 5

| Alloy | Si | Fe | Cu | Mn | Mg | Cr | Ti | Zr | Al |
|---|---|---|---|---|---|---|---|---|---|
| A1 | 0.60 | 0.22 | 0.54 | 0.21 | 0.70 | 0.07 | 0.03 | 0.001 | bal. |
| A2 | 0.59 | 0.22 | 0.39 | 0.20 | 0.70 | 0.07 | 0.03 | 0.001 | bal. |
| A3 | 0.50 | 0.22 | 0.55 | 0.20 | 0.70 | 0.07 | 0.03 | 0.001 | bal. |
| A4 | 0.60 | 0.22 | 0.56 | 0.20 | 0.70 | 0.07 | 0.03 | 0.125 | bal. |
| A5 | 0.62 | 0.21 | 0.54 | 0.19 | 0.70 | 0.12 | 0.04 | 0.001 | bal. |

All expressed in wt. %.

Example 2—Strength and Bendability Testing

Alloys A1-A4 (Table 5) were continuously cast, homogenized at 560° C. for 6 hours, and then rolled to a thickness of 2 mm, with each prepared according to a T4 temper and a T6 temper. FIG. 1 shows results for yield strength and bendability testing. The graph shows the results of the yield strength testing according to ASTM Test No. B557 (2015) with 2" GL for the T4 and T6 tempers for each alloy, which are plotted against the x-axis. The graph also shows the angle for the VDA Bend Test No. 238-100 (with the exception that the test was performed without prestraining), which are plotted against the y-axis.

Example 3—Intergranular Corrosion Testing

Figure 2:
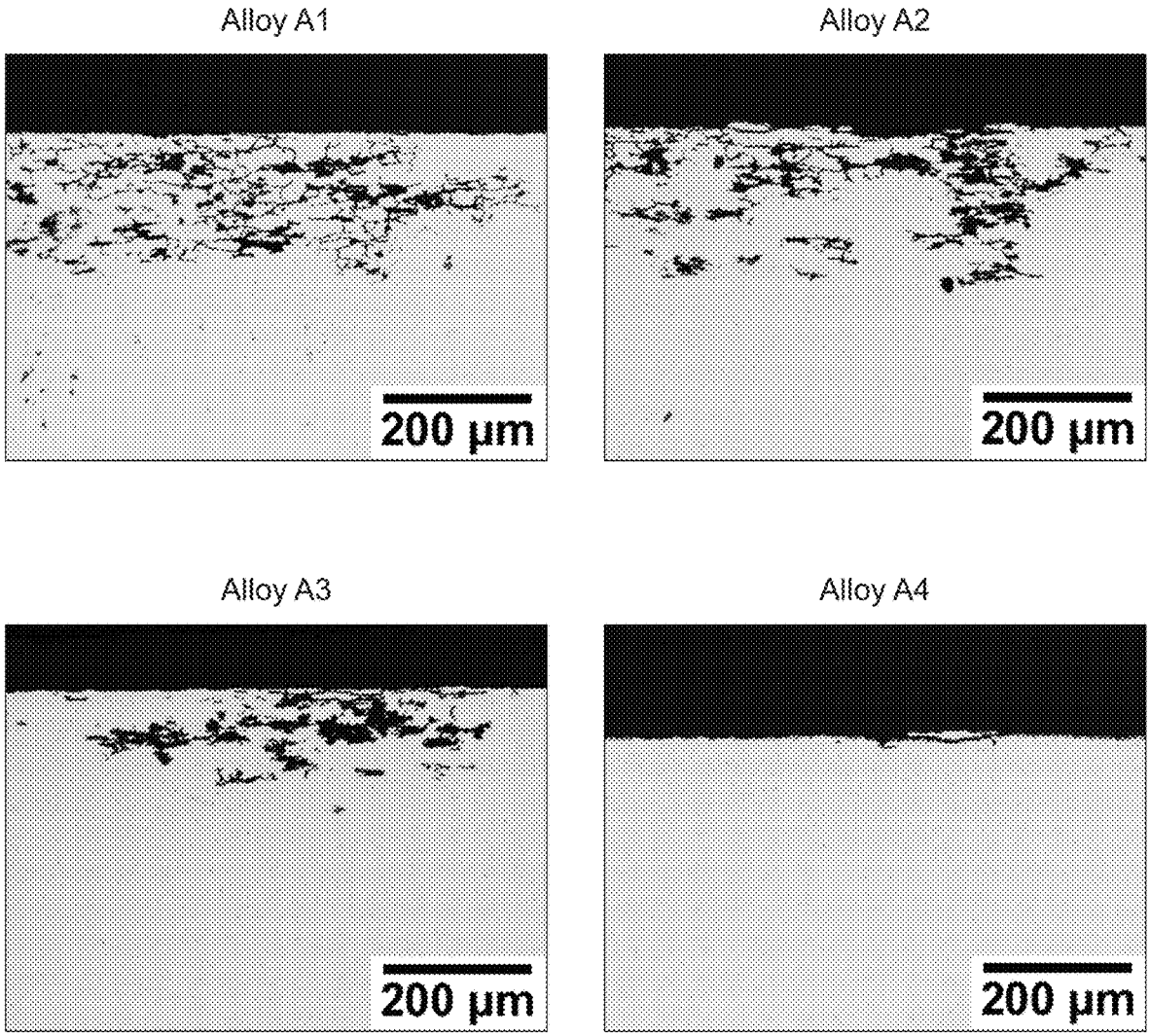
FIG. 2 shows optical micrographs (OMs) for four alloys (A1-A4) each of which was prepared in the T6 temper, and subjected to the intergranular corrosion (IGC) test set forth in ISO 11846B (1995) for 24 hours.
Figure 3:
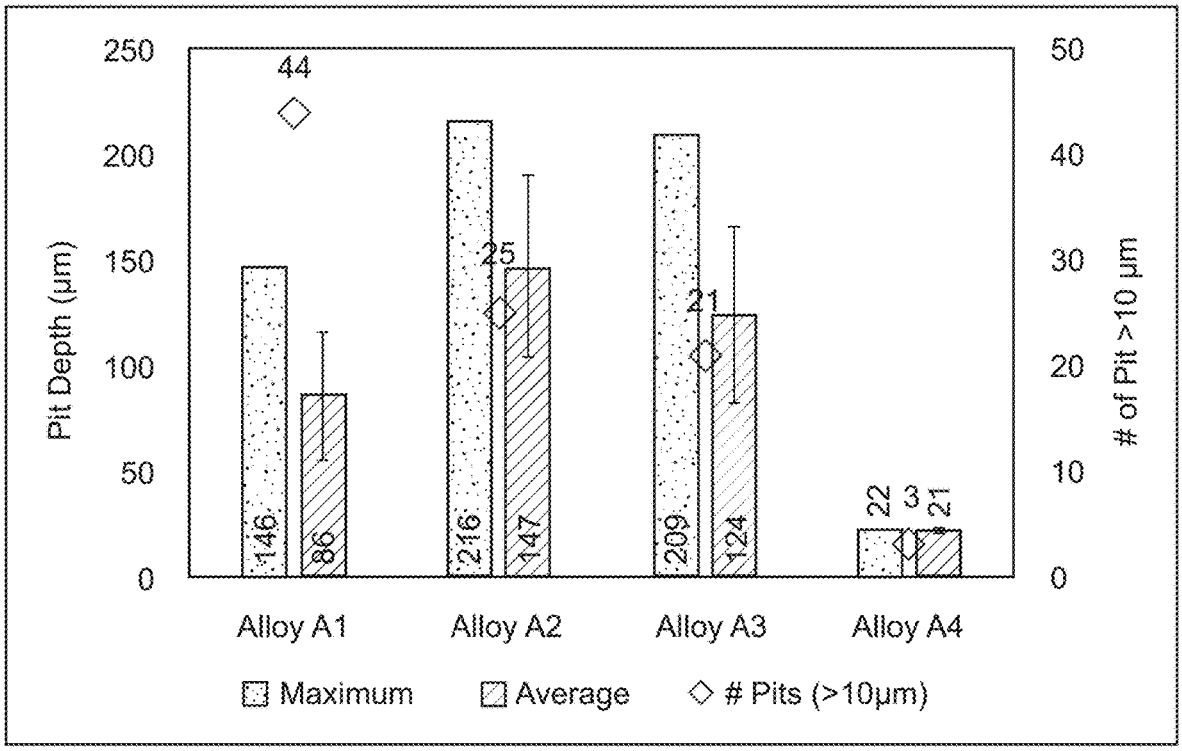
FIG. 3 shows the maximum and average pit depths and number of pits after samples were subjected to the intergranular corrosion (IGC) test set forth in ISO 11846B (1995) for 24 hours. The four samples are the four alloys (A1-A4), each of which was prepared in the T6 temper.

Aluminum alloy sheets of alloys A1-A4 (Table 5) were prepared as described above in Example 2 in the T6 temper. FIG. 2 shows optical micrographs for the four samples after being subjected to the corrosion test set forth in ISO 11846B (1995), with an exposure time of 24 hours. FIG. 3 shows the results of pit depth measurements on the treated samples, where, for each sample, the maximum and average pit depth (in μm) of pits having a depth of more than 10 μm. The diamond indicates the number of pits having a depth of more than 10 μm within the test surface.

Example 4—Effect of Homogenization

Figure 4:
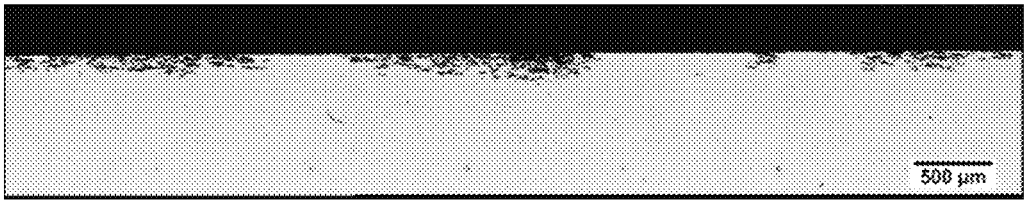
FIG. 4 shows optical micrographs (OMs) for a 6xxx series aluminum alloy with added Zr (A4), each in the T6 temper but prepared in different ways, and subjected to the intergranular corrosion (IGC) test set forth in ISO 11846B (1995) for 24 hours. The four different preparation conditions are indicated on the figure and include (a) homogenization at a temperature increase of 50° C./h to a peak of 450° C. with no soak; (b) homogenization at a temperature increase of 50° C./h to a peak of 500° C. with no soak; (c) homogenization at a temperature increase of 50° C./h to a peak of 540° C. with no soak; and (d) homogenization at a temperature increase of 50° C./h to a peak of 560° C. with a 6-hour soak following homogenization.
Figure 4:
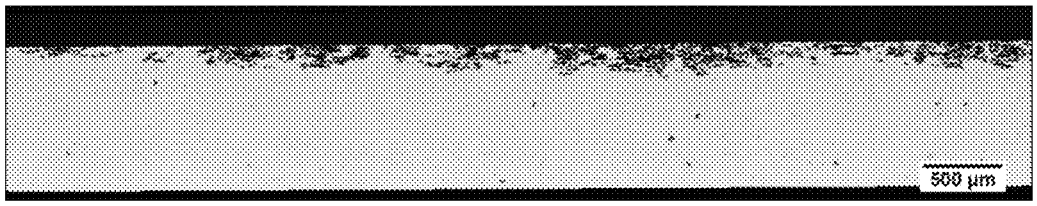
Figure 4:
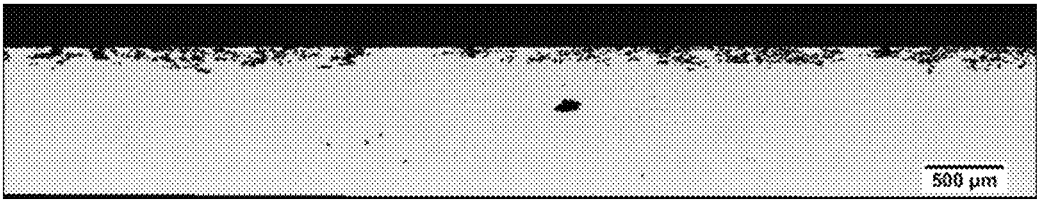
Figure 4:
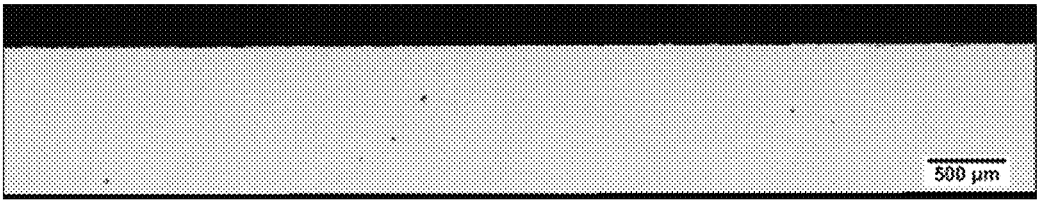

An aluminum alloy sheet of alloy A4 was prepared as described above in Example 2 in the T6 temper, except for differences in the pre-rolling treatment of the sample. Four different preparation conditions were used, as indicated in FIG. 4: (a) homogenization at a temperature increase of 50° C./h to a peak of 450° C. with no soak; (b) homogenization at a temperature increase of 50° C./h to a peak of 500° C. with no soak; (c) homogenization at a temperature increase of 50° C./h to a peak of 540° C. with no soak; and (d) homogenization at a temperature increase of 50° C./h to a peak of 560° C. with a 6-hour soak following homogenization. FIG. 4 shows optical micrographs for the four samples after being subjected to the corrosion test set forth in ISO 11846B (1995), with an exposure time of 24 hours.

The amount of corrosion decreased as the homogenization time and temperature increased. For the sample prepared under condition (d), almost no corrosion pits were seen after 24 hours of exposure in a corrosive environment. The longer homogenization was used to precipitate Zr dispersoids that would pin the grain boundary to result in low angle grain boundary (low energy, less grain boundary precipitation) and act as heterogeneous precipitation sites that reduce/eliminate grain boundary precipitation. Precipitation-free grain boundaries resulted in similar corrosion potentials to grain cores and provided superior corrosion resistance as compared to the other samples.

Example 5—Effect of Casting Method

Figure 5:
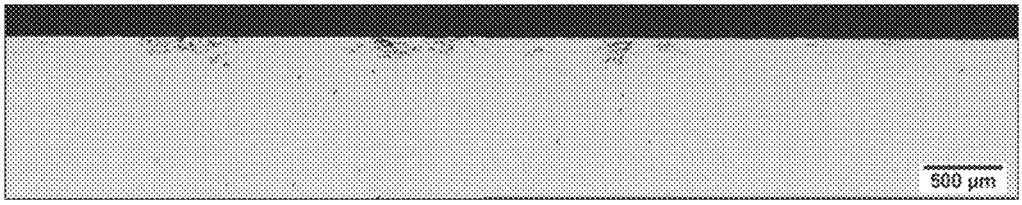
FIG. 5 shows optical micrographs (OMs) for a series of different 6xxx series aluminum alloys cast by different methods, including (a) A1 alloy cast by continuous casting (CC) using a twin-belt caster, (b) A2 alloy cast by continuous casting using a twin-belt caster, (c) A3 alloy cast by continuous casting using a twin-belt caster, (d) A4 alloy cast by continuous casting using a twin-belt caster, and (e) A1 alloy cast by a direct chill (DC) casting, where the samples were prepared in the T6 temper and subjected to the intergranular corrosion (IGC) test set forth in ISO 11846B (1995) for 24 hours.
Figure 5:
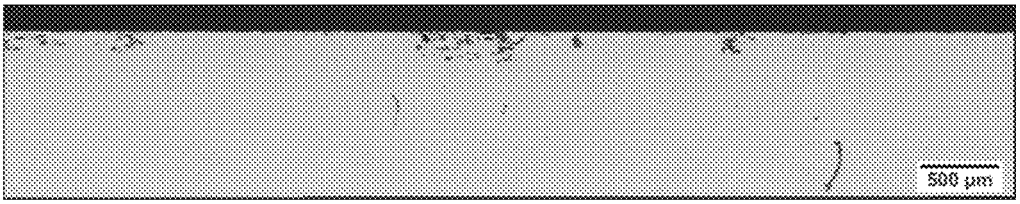
Figure 5:
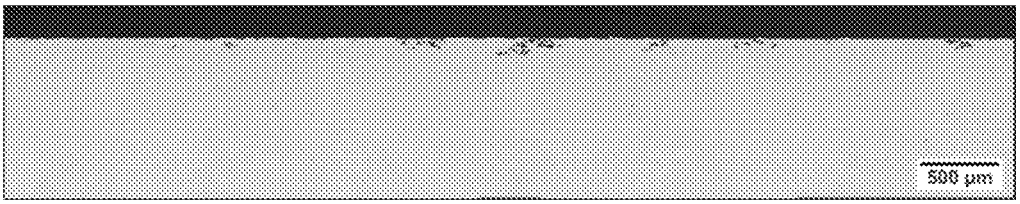
Figure 5:
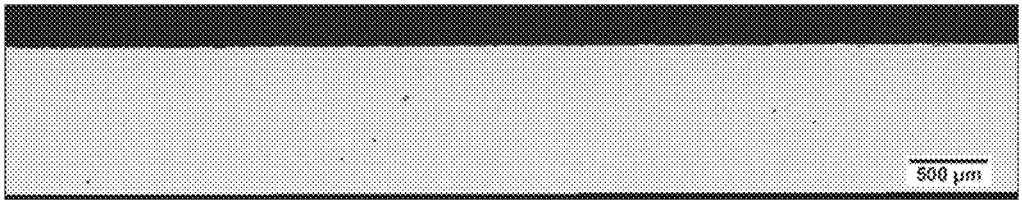
Figure 5:
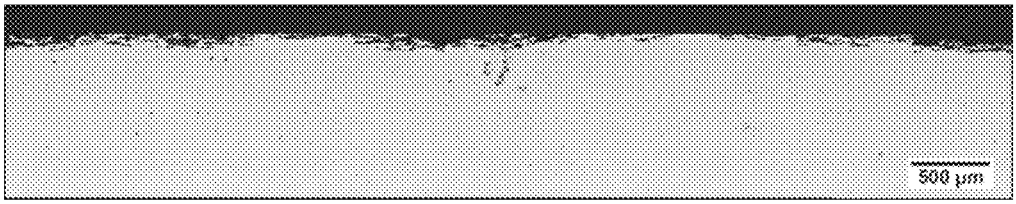

Aluminum alloy sheets of alloys A1-A4 were prepared as described above in Example 2 and subjected to homogenization at 560° C. followed by soaking for 6 hours, except for differences in the casting method. Samples were prepared in the T6 temper. Different casting methods were used for different samples, as indicated in FIG. 5: (a) a standard 6xxx series aluminum alloy (A1) cast by continuous casting using a twin-belt caster ("A1_CC"); (b) A2 cast by continuous casting using a twin-belt caster ("A2 CC"); (c) A3 cast by continuous casting using a twin-belt caster ("A3_CC"); (d) A4 cast by continuous casting using a twin-belt caster ("A4_CC"); and (e) A1 cast by direct chill casting ("A1_DC"). FIG. 5 shows optical micrographs for the five samples after being subjected to the corrosion test set forth in ISO 11846B (1995), with an exposure time of 24 hours.

Sample A4_CC showed almost no corrosion pits compared to the other samples (A1_CC, A2_CC, A3_CC, and A1_DC). Samples A1_CC and A1_DC, having similar compositions, showed different corrosion morphologies due to different casting and processing methods. The CC process route allowed for most of the solute in solid solution to be uniformly distributed as compared to the DC process route, where the process resulted in micro segregation from grain boundary to grain core that deteriorated the corrosion performance/resistance. Lowering the Cu content (A2_CC) also enhanced the corrosion resistance compared to A1_CC as it reduced the total strengthening precipitates that reduced the overall driving force. Lowering the Si content (A3_CC) also enhanced the corrosion resistance as compared to A1_CC for the same reason. However, Si has a higher diffusivity compared to Cu and thus the low Si content version (A3_CC) showed more corrosion resistance as compared to the low Cu version (A2_CC). Finally, the Zr content version (A4_CC) showed superior corrosion performance/resistance as compared to A1_CC, A2_CC, and A3_CC due to a larger number density of Zr dispersoids that formed low angle grain boundaries (low energy, less precipitation) and acted as heterogeneous nucleation sites to avoid grain boundary precipitation and improved corrosion resistance.

Illustrations of Suitable Alloys, Products, and Methods

As used below, any reference to a series of illustrative alloys, products, or methods is to be understood as a reference to each of those alloys, products, or methods disjunctively (e.g., "Illustrations 1-4" is to be understood as "Illustration 1, 2, 3, or 4").

Illustration 1 is an aluminum alloy, comprising: 0.2 to 1.5 percent by weight Si; (b) 0.4 to 1.6 percent by weight Mg; (c) 0.2 to 1.5 percent by weight Cu; (d) no more than 0.5 percent by weight Fe; (e) one or more additional alloying elements selected from the group consisting of: (e1) 0.08 to 0.20 percent by weight Cr; (e2) 0.02 to 0.20 percent by weight Zr; (e3) 0.25 to 1.0 percent by weight Mn; and (e4) 0.01 to 0.20 percent by weight V; and (f) with the remainder aluminum.

Illustration 2 is an alloy of any preceding or subsequent illustration, comprising 0.08 to 0.20 percent by weight Cr.

Illustration 3 is an alloy of any preceding or subsequent illustration, comprising: no more than 0.02 percent by weight Zr; no more than 0.25 percent by weight Mn; and no more than 0.02 percent by weight V.

Illustration 4 is an alloy of any preceding or subsequent illustration, comprising 0.02 to 0.20 percent by weight Zr.

Illustration 5 is an alloy of any preceding or subsequent illustration, comprising: no more than 0.10 percent by weight Cr; no more than 0.25 percent by weight Mn; and no more than 0.02 percent by weight V.

Illustration 6 is an alloy of any preceding or subsequent illustration, comprising 0.25 to 1.0 percent by weight Mn.

Illustration 7 is an alloy of any preceding or subsequent illustration, comprising: no more than 0.10 percent by weight Cr; no more than 0.02 percent by weight Zr; and no more than 0.02 percent by weight V.

Illustration 8 is an alloy of any preceding or subsequent illustration, comprising 0.01 to 0.20 percent by weight V.

Illustration 9 is an alloy of any preceding or subsequent illustration, comprising: no more than 0.10 percent by weight Cr; no more than 0.02 percent by weight Zr; and no more than 0.25 percent by weight Mn.

Illustration 10 is an alloy of any preceding or subsequent illustration, wherein the aluminum alloy comprises no more than 0.20 percent by weight Sr, no more than 0.20 percent by weight Hf, no more than 0.20 percent by weight Er, or no more than 0.20 percent by weight Sc.

Illustration 11 is an alloy product comprising the aluminum alloy of any preceding or subsequent illustration.

Illustration 12 is an alloy product of any illustration 11, wherein the aluminum alloy product is a rolled aluminum alloy product comprising a rolled surface.

Illustration 13 is an alloy product of any of illustrations 11-12, wherein the aluminum alloy product is an aluminum alloy sheet having a thickness of no more than 7 mm.

Illustration 14 is an alloy product of illustration 13, wherein, when subjected to test conditions set forth in ISO 11846B (1995) for an exposure period of 24 hours, the rolled surface has a maximum pit depth of no more than 140 μm.

Illustration 15 is an alloy product of any of illustrations 13-14, wherein the rolled surface has a maximum pit depth of no more than its average grain size, where average grain size is measured by the ASTM E112 (2004) method.

Illustration 16 is an alloy product of any of illustrations 13-15, which, when rolled to a thickness of 2 mm and prepared to a T6 temper, has a yield strength of at least 260 MPa, when measured according to ASTM Test No. B557 (2015), and a bend angle of at least 55°, when measured according to the Verband der Automobilindustrie (VDA) Test No. 238-100 with the exception that the test was performed without prestraining.

Illustration 17 is a method of making an aluminum alloy product, comprising: providing an aluminum alloy of any of illustrations 1-10, wherein the aluminum alloy is provided in a molten state as a molten aluminum alloy; and continuously casting or direct chill casting the molten aluminum alloy to form an aluminum alloy product.

Illustration 18 is a method of illustration 17, further comprising homogenizing the aluminum alloy product to form a homogenized aluminum alloy product, wherein the homogenization is carried out at a peak temperature of at least 540° C.

Illustration 19 is a method of illustration 17, further comprising hot rolling the homogenized aluminum alloy product to form an aluminum alloy sheet having a first thickness of no more than 7 mm.

Illustration 20 is a method of any of illustrations 17-19, wherein the aluminum alloy product is formed without the use of cold rolling.

All patents, patent applications, publications, and abstracts cited above are incorporated herein by reference in their entirety. Various embodiments of the invention have been described in fulfillment of the various objectives of the invention. It should be recognized that these embodiments are merely illustrative of the principles of the present invention. Numerous modifications and adaptations thereof will be readily apparent to those of ordinary skill in the art without departing from the spirit and scope of the invention as defined in the following claims.

What is claimed is:

1. An aluminum alloy, comprising:
(a) 0.2 to less than 0.7 percent by weight Si;
(b) 0.4 to 1.6 percent by weight Mg;
(c) 0.2 to 1.5 percent by weight Cu;
(d) no more than 0.5 percent by weight Fe;
(e) 0.0001 to 0.20 percent by weight Zr; and
(f) with the remainder as aluminum.

2. The aluminum alloy of claim 1, further comprising 0.08 to 0.20 percent by weight Cr.

3. The aluminum alloy of claim 2, further comprising: no more than 0.25 percent by weight Mn; and
no more than 0.02 percent by weight V.

4. The aluminum alloy of claim 1, wherein a ratio of Mg to Si is 1:1 or greater.

5. The aluminum alloy of claim 4, further comprising:
no more than 0.10 percent by weight Cr;
no more than 0.25 percent by weight Mn; and
no more than 0.02 percent by weight V.

6. The aluminum alloy of claim 1, further comprising 0.25 to 1.0 percent by weight Mn.

7. The aluminum alloy of claim 6, further comprising:
no more than 0.10 percent by weight Cr;
and
no more than 0.02 percent by weight V.

8. The aluminum alloy of claim 1, comprising 0.01 to 0.20 percent by weight V.

9. The aluminum alloy of claim 8, further comprising:
no more than 0.10 percent by weight Cr;
and
no more than 0.25 percent by weight Mn.

10. The aluminum alloy of claim 1, wherein the aluminum alloy further comprises no more than 0.20 percent by weight Sr, no more than 0.20 percent by weight Hf, no more than 0.20 percent by weight Er, or no more than 0.20 percent by weight Sc.

11. An aluminum alloy product comprising of an aluminum alloy of claim 1.

12. The aluminum alloy product of claim 11, wherein the aluminum alloy product is a rolled aluminum alloy product comprising a rolled surface.

13. The aluminum alloy product of claim 12, wherein the aluminum alloy product is an aluminum alloy sheet having a thickness of no more than 7 mm.

14. The aluminum alloy product of claim 13, wherein, when subjected to test conditions set forth in ISO 11846B (1995) for an exposure period of 24 hours, the rolled surface has a maximum pit depth of no more than 140 μm.

15. The aluminum alloy product of claim 13, wherein the rolled surface has a maximum pit depth of no more than its average grain size, where average grain size is measured by the ASTM E112 (2004) method.

16. The aluminum alloy product of claim 13, which, when rolled to a thickness of 2 mm and prepared to a T6 temper, has a yield strength of at least 260 MPa, when measured according to ASTM Test No. B557 (2015), and a bend angle of at least 55°, when measured according to the Verband der Automobilindustrie (VDA) Test No. 238-100 with the exception that the test was performed without prestraining.

17. A method of making an aluminum alloy product, comprising:

providing an aluminum alloy of claim 1, wherein the aluminum alloy is provided in a molten state as a molten aluminum alloy; and continuously casting or direct chill casting the molten aluminum alloy to form an aluminum alloy product.

18. The method of claim 17, further comprising homogenizing the aluminum alloy product to form a homogenized aluminum alloy product, wherein the homogenization is carried out at a peak temperature of at least 540° C.

19. The method of claim 18, further comprising hot rolling the homogenized aluminum alloy product to form an aluminum alloy sheet having a first thickness of no more than 7 mm.

20. An aluminum alloy sheet, comprising (a) 0.2 to less than 0.7 percent by weight Si;

(b) 0.4 to 1.6 percent by weight Mg;

(c) 0.2 to 1.5 percent by weight Cu;

(d) no more than 0.5 percent by weight Fe;

(e) 0.0001 to 0.20 percent by weight Zr; and (f) with the remainder aluminum;

wherein the aluminum alloy sheet has an average intergranular corrosion attack attach depth of no more than 85 micrometers.

* * * * *